United States Patent [19]

Luchaco

[11] 4,174,681

[45] Nov. 20, 1979

[54] TWO-GROUP/SIMULTANEOUS FULL INJECTION CONVERSION SYSTEM FOR MULTIPLE CYLINDER ENGINES

[75] Inventor: David G. Luchaco, Macungie, Pa.

[73] Assignee: The Bendix Corporation, Troy, Mich.

[21] Appl. No.: 816,250

[22] Filed: Jul. 18, 1977

[51] Int. Cl.[2] ..... F02B 3/00

[52] U.S. Cl. ..... 123/32 EA; 123/32 EL; 123/32 EH

[58] Field of Search ..... 123/32 EA, 139 E, 32 EL, 123/32 AE, 32 EH

[56] References Cited

U.S. PATENT DOCUMENTS

| | | | |
|---|---|---|---|
| 3,463,130 | 8/1969 | Reichardt et al. | 123/32 EL |
| 3,570,460 | 3/1971 | Rubus | 123/32 EL |
| 3,587,536 | 6/1971 | Inoue et al. | 123/32 EA |
| 3,699,932 | 10/1972 | Aono et al. | 123/139 E |
| 3,777,726 | 12/1973 | Knapp et al. | 123/32 AE |
| 3,854,458 | 12/1974 | Reddy | 123/32 AE |
| 4,020,802 | 5/1977 | Hattori et al. | 123/32 EH |

FOREIGN PATENT DOCUMENTS

| | | | |
|---|---|---|---|
| 2004269 | 8/1970 | Fed. Rep. of Germany | 123/32 EA |

*Primary Examiner*—Charles J. Myhre
*Assistant Examiner*—P. S. Lall
*Attorney, Agent, or Firm*—Robert C. Smith; Russel C. Wells

[57] ABSTRACT

An electrical fuel injection system incorporates electromagnetic injectors wired in two groups and which are operated on alternate cycles during low speed and normal operation. With increasing power demands, the fuel injection computer supplies pulses of increasing length to keep the injectors open longer and supply more fuel to the engine. Two trains of timing pulses are initiated by reed switches operated by the distributor, and each is connected to a pair of latch circuits operative to provide timing pulses on one channel through gate devices to one set of injectors and to block pulses on a second channel to the other set of injectors. The subsequent signal from the other reed switch results in a timing pulse in the second channel. These timing pulses are supplied to the fuel injection computer to initiate the injection pulses and to AND gates which also receive the timing pulses. Under high power demand conditions, an injection pulse may become longer than the time interval between the two trains of timing pulses, and hence a timing pulse is overlapped by an injection pulse from the opposite switch. When this happens, the associated AND gate provides an output pulse to one of two additional latch circuits to cause this latch to provide an output effectively blocking one of said channels and switching additional gate devices to enable both channels to be energized simultaneously by the injection pulses in the second channel. The length of the injection pulse is also measured by any of a plurality of disclosed devices such that when the pulse length drops to approximately 40% of the duty cycle, an output is provided which resets said additional latch circuits to cause said circuits to switch back to two-group operation.

11 Claims, 4 Drawing Figures

TWO-GROUP/SIMULTANEOUS FULL INJECTION CONVERSION SYSTEM FOR MULTIPLE CYLINDER ENGINES

BACKGROUND OF THE INVENTION

An electronic fuel injection system for engines such as automobile engines regulates fuel flow to the engine by varying the time interval that the injectors are held open through controlling the length of electrical pulses supplied to solenoid injectors. These injector opening periods are synchronized to the engine operating cycle by trigger pulses timed with the engine. The trigger pulses are typically generated by switching means such as reed switches in the distributor.

At high manifold pressures and rpm conditions, the injectors must be held open for the longest period to provide the required maximum fuel flow. To avoid degrading accuracy at low fuel requirement conditions, this period of maximum injector opening time is in the order of 10 milliseconds.

In high performance engines, engine speeds in the neighborhood of 8000 revolutions per minute are quite possible. Where injection trigger pulses are supplied alternately to two groups of cylinders, this corresponds to an injection pulse being called for every 7.5 milliseconds. Because the pulse generator is shared between the groups, it is not practical to generate overlapping pulse widths. If an injection trigger is received before the injection pulse has finished (i.e., 7.5 milliseconds pulse interval with 10 milliseconds pulse lengths), the pulse in progress is or may be immediately terminated, and the opposite group of injectors receive a trigger pulse. This will cause a leaning in fuel flow because the injectors are now open only 7.5 milliseconds instead of the 10 milliseconds really required for full performance.

A solution to this problem has been generated wherein, instead of injecting fuel in two groups, under some conditions of high-speed operation means are employed to inject all cylinders simultaneously. This makes it possible to supply trigger pulses with only half the frequency or once every 15 milliseconds. This permits a 10-millisecond required pulse width to be completed before the next trigger pulse arrives. Simultaneous injection arrangement is not satisfactory at lower engine operating speeds because of emission penalties, transient drivability problems and plug wetting due to injecting through open intake valves. Thus, the preferred method of operation is to provide the two-group injection described above with means for switching to simultaneous injection under certain high engine operating speed conditions. In U.S. Pat. No. 3,724,431 a system is described which switches from two-group operation to simultaneous operation, and vice versa, through the operation of a switch which simply responds to the sensing of a given engine operating speed. While quite operative, this system is believed to suffer from certain specific disadvantages. Since the pulse length of each injector pulse varies in accordance with engine manifold pressures, coolant temperatures, etc., the engine rpm at which the two-group injection pulses become of such length as to run into the timing problem described above is subject to considerable variation. Therefore, switching over to simultaneous injection at engine rotational speeds significantly lower than necessary can result in some emission penalties, transient drivability problems, etc., as described above. Another concern is that in operation in which the transition from two-group injection to simultaneous injection occurs simply as a result of operation of a single speed-responsive switch, there is danger of oscillation between the two modes at operating conditions close to the switching threshold.

SUMMARY OF THE INVENTION

To meet the problems described above, applicant has devised a system in which switching from two-group to simultaneous injection and from simultaneous injection of two-group operation is accomplished on what is essentially a duty cycle basis. All operation at low and moderate speeds occurs with two-group injection. Two trains of timing or trigger pulses are produced in each of which pulses are generated in direct proportion to engine rpm, the pulses alternating in time. The trigger pulses initiate injector pulses which cause fuel to be injected into the engine intake manifold or manifolds. The injector pulses vary in pulse length with engine operating conditions as described above, and at some condition of high rpm and power demand the width (or length) of the injector pulse will increase such that it extends into the time period at which the alternate injector pulse should be initiated. The switching system responds to the occurrence of a trigger pulse from the second group before a first group pulse has terminated and switches to simultaneous injection. During simultaneous injection the switching system will respond to trigger pulses of one group and will ignore the other, selection of which group being dependent upon which trigger pulse happens to be excited before the normal termination of the injector pulse width. The system then gates pulses from the computer to both output groups at the same time, opening all injectors simultaneously.

To switch from simultaneous injection back to two-group operation, means are provided for sensing the duty cycle of the output of the main computing circuitry. The computer operates in such manner as to produce a correct length of output pulse for every trigger input. If the computer is triggered before it has completed a correct output pulse, it resets itself and begins generating a new output pulse. Thus, if the trigger pulses occur more rapidly than the computer can generate correct output pulses, the computer is effectively generating a continuous output or a pulse train of 100% duty cycle. As indicated above, when the overlapping condition occurs, the number of trigger pulses per unit of time are reduced by half. Assuming the pulse width remains constant, the duty cycle drops to 50% and the system operates in the simultaneous injection mode. Thus it is apparent that any time the duty cycle sensed while operating in simultaneous injection mode falls below 50%, it would be safe to switch to two-group injection since the resulting duty cycle would be less than 100%. To provide insurance against the system oscillating between two-group injection and simultaneous injection modes, the system is set to switch back to two-group injection when the sensed pulse duty cycle during simultaneous injection falls to 40%. The 10% hysteresis is sufficient to prevent oscillation between the two modes at operating conditions close to the switching threshold.

DESCRIPTION OF THE PREFERRED EMBODIMENT

Figure 1:
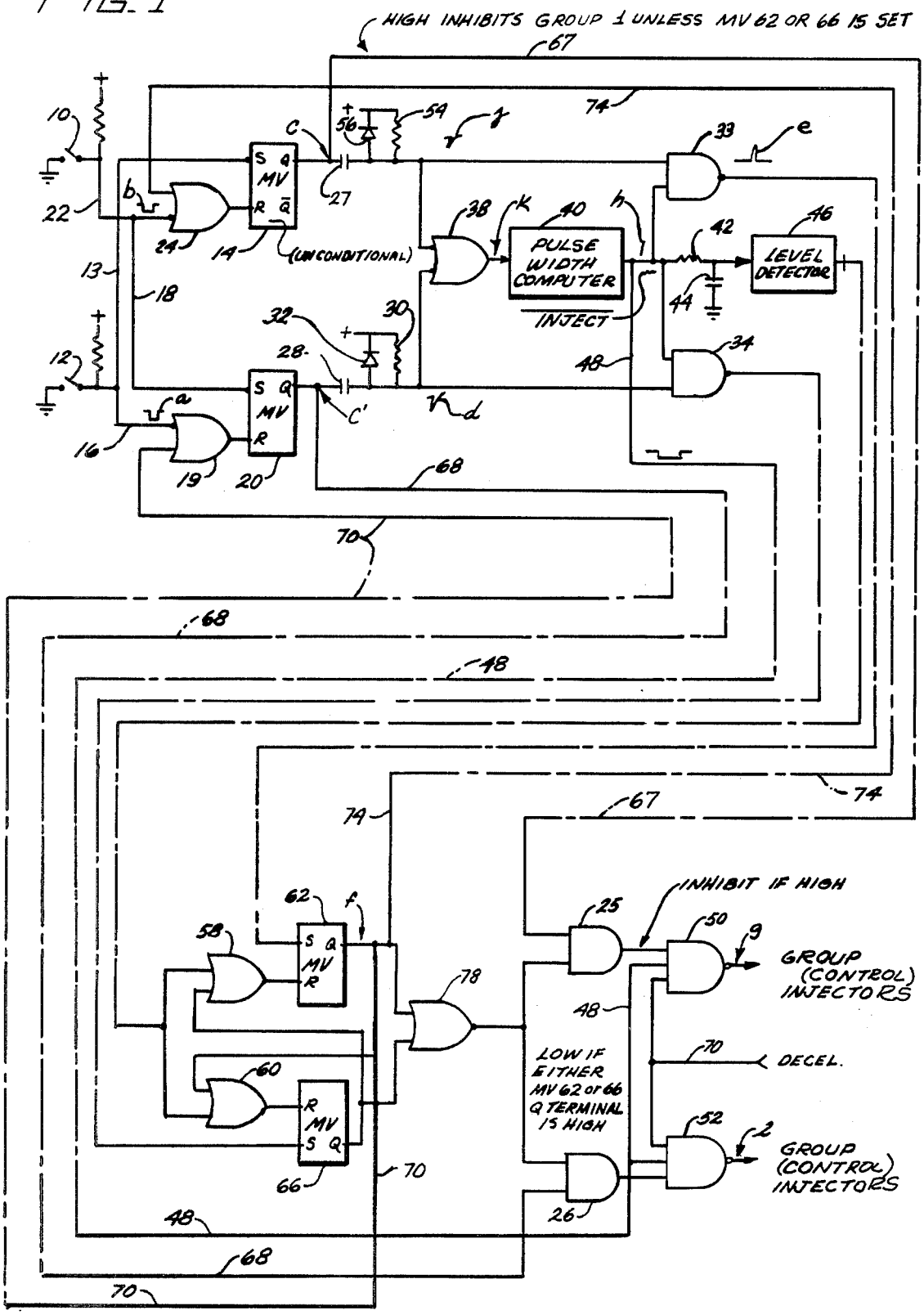
FIG. 1 is a schematic block diagram of an injector pulse timing system for a fuel injection system according to my invention.

Referring now to FIG. 1, a pair of switches 10 and 12 are shown which are normally incorporated into the engine-driven distributor of the associated engine. Switches 10 and 12 are operated by a rotating magnet which rotates with the distributor shaft and are spaced on opposite sides of a circle, 180° apart. Since the distributor shaft turns at one-half the crankshaft speed, one of switches 10 or 12 is energized every crankshaft revolution with the switches alternating revolutions. Each switch closure, whether of switch 10 or switch 12, causes a negative-going trigger pulse to be generated. These pulses are indicated on waveforms a and b of FIG. 2 where it will be observed that they alternate in time. Pulses a from switch 12 are supplied on a line 13 to the "set" terminal of a latch circuit in the form of a multivibrator 14 and on a line 16 to an input terminal of an OR gate 19 which has its output connected to the "reset" terminal of a second latch circuit or multivibrator 20. Similarly, a line 18 carries pulses b (FIG. 2) from switch 10 to the "set" terminal of multivibrator 20, and a line 22 carries said pulse to an OR gate 24 having its output connected to the reset terminal of multivibrator 14. The negative-going pulse on line 13 results in a positive output at the Q terminal of multivibrator 14 (curve c, FIG. 2), which is also supplied through a line 67 to an AND gate 25. This positive or high output inhibits an output from gate 25. The same pulse b appearing at the input to OR gate 19 is supplied to the reset terminal of multivibrator 20 where it will cause the multivibrator to produce a negative-going or low output c' at its Q terminal. When signal c' goes negative, this negative signal is supplied along line 68 to one input of AND gate 26. The signal is also differentiated by means of a capacitor 28 and passes a clamp circuit consisting of a resistor 30 and a parallel connected diode 32 which are connected to a source of positive voltage. The clamp circuit results in removal of a positive-going spike which might otherwise appear at the input to a NAND gate 34 and also at the input to an OR gate 38. The differentiated sharp timing pulse d, after passing through OR gate 38, serves to initiate injection pulses h from the pulse width computer 40. The width (or length) of the pulses h supplied by pulse width computer 40 is determined by computer 40 from input signals representing values of a number of engine operating conditions not involved with the present invention.

The injection pulses h are connected to NAND gates 33 and 34, to an integration circuit including a series resistor 42 and a capacitor 44 connected to ground which supplies a level detector circuit 46 and also to a line 48 having connections to input terminals of each of two NAND gates 50 and 52.

When switch 10 closes, operation is analogous to that described above with respect to switch 12. The negative going pulse on line 18 sets multivibrator 20, holding its terminal Q at a positive potential and preventing any timing pulse from reaching either of NAND gate 34 or OR gate 38. This same pulse supplied at the input to OR gate 24 resets multivibrator 14 and causes a negative-going pulse c to appear at its terminal Q. This pulse is differentiated in a differentiation and clamp circuit consisting of a capacitor 27, a resistor 54 and a diode 56 connected to a positive voltage source. Resistor 54 and diode 56 remove the positive-going spike or sharp pulse described above. The resulting sharp negative-going timing pulse j is supplied to NAND gate 33 and to OR gate 38 where it initiates a new injection pulse which is supplied to NAND gates 33 and 34, integration circuit 42, 44 and through line 48 to NAND gates 50 and 52. Since the system operates with a series of negative-going timing pulses, the injection pulses are also negative-going and are designated at the output of computer 40 as "inject" or "not inject".

The integrated "not inject" pulses are supplied to the level detector 46 where they tend to lower the normally positive voltage output of circuit 46. The level detector produces an output only when each "not inject" pulse corresponds to 40% or less of the duty cycle. At duty cycles above 40% there will be no output from level detector 46. This output level signal appears at the input of each of two OR gates 58 and 60 which are connected to the reset terminals of a pair of additional latch circuits in the form of multivibrators 62 and 66, respectively, where they operate to reset these multivibrators such that the output at their Q terminals will be at a low voltage. This low voltage output from multivibrators 62 and 66 will appear at the two input terminals of a NOR gate 78 which will then have a high voltage output which is supplied to one of the two input terminals of each of AND gates 25 and 26. Thus, where a negative going pulse appears at c, this pulse is connected through line 67 to the opposite input terminal of AND gate 25, and since one input is at a comparatively high voltage level and the other input is low, the output will be low to the NAND gate 50. Since the "not inject" signal is also low and there has been no deceleration command, the deceleration signal is therefore low, and NAND circuit 50 will conduct an injection pulse to operate the Group I fuel injectors. At this same time, the high voltage level appearing at c', which is conducted on line 68 to one of the inputs of AND circuit 26 combines with the input from NOR gate 78 to produce the high voltage output from gate 26 which will effectively inhibit any output from NAND gate 52.

Operation is entirely analogous when switch 12 goes negative and places a low voltage on line 16, thereby effectively resetting multivibrator 20 producing a low voltage at c' and a sharp negative-going timing pulse d. The low voltage on line 68 does not satisfy AND circuit 26 which thereby produces a low voltage input into NAND gate 52. Again, since the "not inject" signal is also a low voltage output, this, in conjunction with an absence of a deceleration signal, will result in the high voltage pulse output from NAND gate 52 to the Group II injectors.

Figure 2:
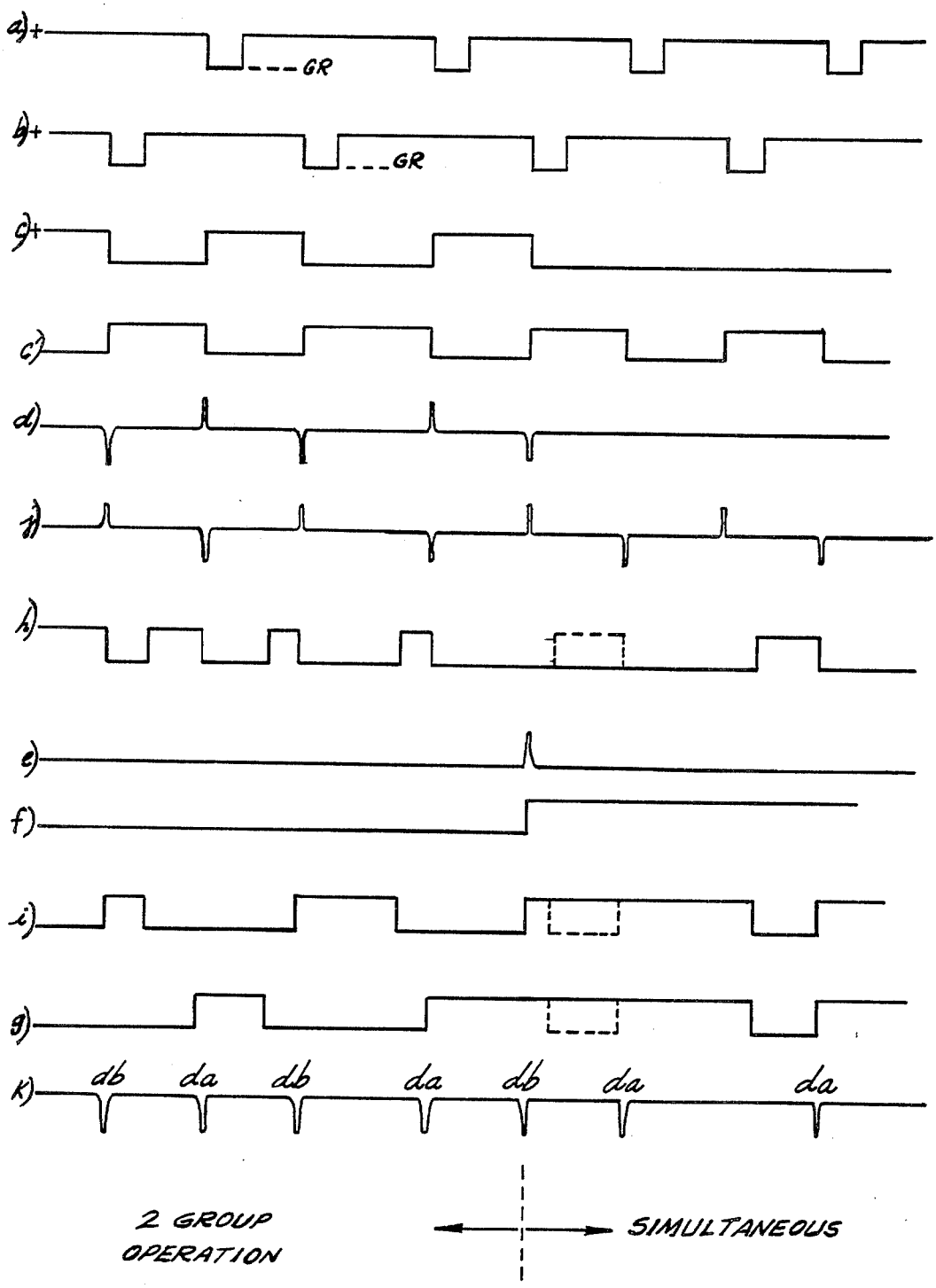
FIG. 2 is a series of graphs representing timing diagrams of the wave forms occurring at various junctions of FIG. 1 during operation of the injection system.

From the above description, it will be apparent that timing pulses arrive at NAND gates 33 and 34 in alternate time periods as shown in curves d and j of FIG. 2. Each of pulses d and j initiates an injection pulse from computer 40. So long as the engine is operating in a low power or normal regime, the injection pulses are concluded before the next timing pulse reaches either of NAND gates 33 or 34; hence, neither of these gates will have an output, and operation is as described above. As increasingly higher output demands are placed on the engine, the pulse width computer will provide longer and longer injection pulses until a point is reached at approximately 50% duty cycle where, for example, the timing pulse j arrives at NAND gate 33 before the "not inject" pulse from computer 40 has terminated. This will cause the gate 33 to produce a pulse output in the form of a positive spike operating to set the multivibrator 62 and causing its Q output to go to a high value. This high voltage output signal is supplied to one of the inputs of OR gate 60 and from thence to the reset terminal of multivibrator 66, tending to hold multivibrator 66 in a reset position with a low voltage output at its Q terminal. At the same time, this high voltage output from multivibrator 62 is fed back through a line 74 to the input of OR gate 24 where it operates to inhibit the reset of multivibrator 14, thereby holding its Q terminal at a high positive output value which blocks pulses "b" from switch 10. The high output at the Q terminal of multivibrator 62 is also supplied as an input to the NOR gate 78, causing this gate to produce a low input to AND gates 25 and 26. Since this set of conditions will produce a high voltage at c, AND gate 25 is not satisfied. Therefore, its output is low, enabling NAND gate 50 to supply injection pulses. Gate 26 also has a low output since its other input is also low from line 68; thus, it enables NAND gate 52. Pulses "a" from switch 12 then provide the only timing pulses for the "not inject" pulses which are gated to both NAND gates 50 and 52, thus injecting both groups simultaneously.

This operation may be somewhat more straightforward from consideration of the several wave forms of FIG. 2. Note that injection pulses are alternatively initiated by differentiated pulses db and da as shown on graph k. These pulses are shown to be lengthening with time which is plotted toward the right. The third pulse db is overlapped by the injection pulse as indicated, thus producing a triggering output e from NAND gate 33 and setting multivibrator 62, causing its output to go high as indicated at wave form f. Although the third pulse db is overlapped, it does become an input to computer 40, thereby restarting the injection pulse h and causing it to continue rather than stopping and starting as indicated by the dashed pattern. Before this injection pulse can stop, it is again restarted by the third pulse da which will then cause the injection pulse to continue for an amount which may be approximately ten milliseconds. Thus, rather than incur starvation or excessive leaning, an appreciable overlap occurs at the time of switching over to simultaneous injection. This characteristic is also apparent from wave forms g and i which show, in inverted form, the injection pulses supplied to the two groups. Again it will be seen that the third pulse db, even though overlapped by the injection pulse triggered by the previous pulse da, resets the computer 40 causing it to initiate a new injection pulse which fills in the dashed area shown on these curves. Thus there are elongated injection pulses which do not start simultaneously but which continue to both groups until the end of the pulse initiated by the third timing pulse da.

When the engine decelerates, the voltage on line 70 is high, or true, and both of NAND gates 50 and 52 are cut off, blocking all injector pulses. After a deceleration, reapplications of power will cause the injection system to be operated in two-group injection or simultaneous injection depending upon the injector duty cycle then called for. Because of the latching of either of multivibrators 62 or 66, simultaneous injection will continue down to the point where level detector 46 senses an injection pulse width representing 40% or less of the potential injection duty cycle. In this manner a 10% hysteresis is available to prevent the system from oscillating between two-group and simultaneous injection. Where each "not inject" pulse is at 40% or less, level detector 46 produces an output signal which resets multivibrators 62 and 66, giving both a low-level output as their Q terminals which puts a high at the output of NOR gate 78 and therefore a high at one input to each of AND gates 25 and 26. At this point, either of pulses c or c' is high and the other is low. This will inhibit either of NAND gates 50 or 52 and the other will conduct, thus restarting two-group injection.

Figure 3:
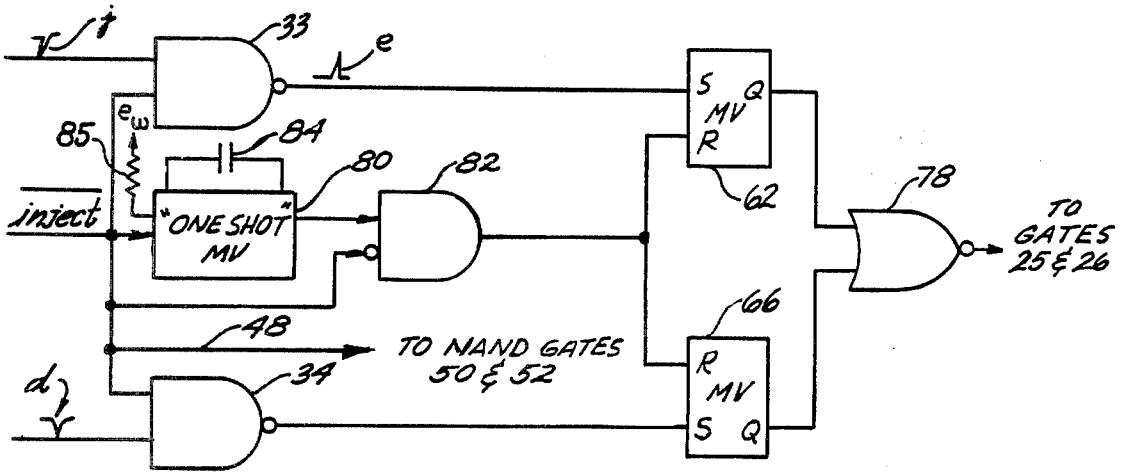
FIG. 3 is a schematic block diagram of an embodiment consisting of a modification of the system of FIG. 1.

A modification of the system shown in FIG. 1 appears in FIG. 3. In this embodiment all the elements of the system are as shown in FIG. 1 except for the arrangement of FIG. 3 which replaces the integration circuit 42, 44, the level detector 46 and OR gates 58 and 60. In FIG. 3 the "not inject" signal from computer 40, in addition to being supplied to NAND gates 33 and 34 and to NAND gates 50 and 52, is also supplied to a "one shot" multivibrator 80 which is triggered by the leading edge of the "not inject" pulse. The output of the multivibrator 80 is supplied to an AND gate 82 along with the inverse of the "not inject" signal. Multivibrator 80 produces a pulse of a definite length (or width) as controlled by a timing element which is here designated as a capacitor 84. This pulse width may be varied by connecting a voltage varying with engine rotational speed ($e_w$) through a resistor 85 to the "one shot" multivibrator 80. This permits the reference to vary as a function of engine speed. The length of the pulse output of multivibrator 80 is chosen to represent a pulse of 40% duty cycle. When the "not inject" pulse becomes shorter than 40% duty cycle, AND gate 82 produces an output to the reset terminals of multivibrators 62 and 66, causing their Q terminals to be reset to a low voltage value and causing the system to revert to two-group injection as set forth above.

Figure 4:
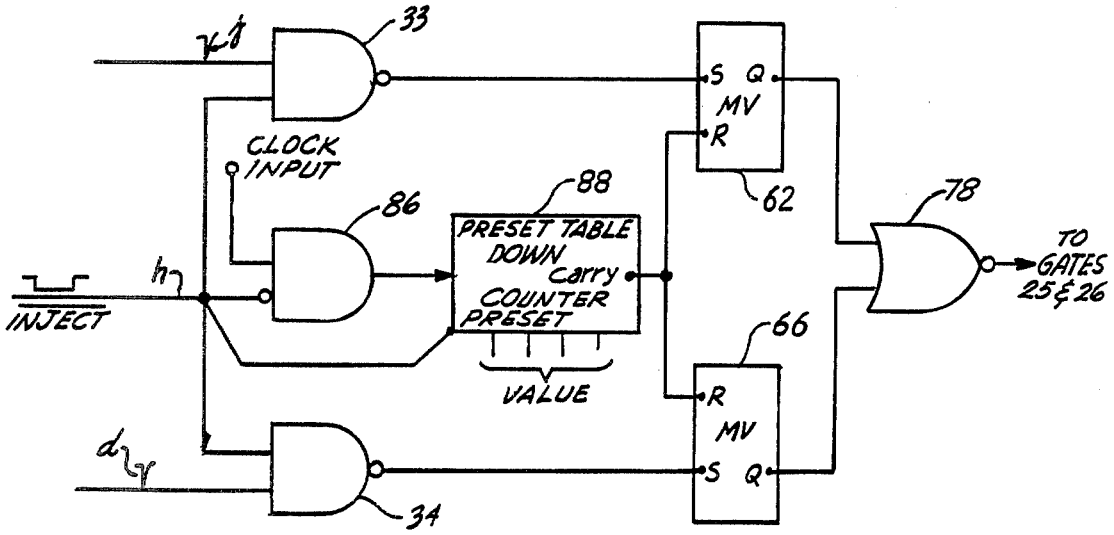
FIG. 4 is a schematic block diagram of another modification of the system of FIG. 1.

FIG. 4 shows a third embodiment of my system in which a digital counter arrangement is used to establish the duty cycle signal into multivibrators 62 and 66. Again the "not inject" pulse from computer 40 is supplied to NAND gates 50 and 52 on line 48 and to NAND gates 33 and 34 as set forth above. It is also supplied to an AND gate 86 which has on its other input terminal an input from a digital clock which may be any of several types. The clock signal is preferably synchronized with the distributor (to make a speed-variable reference), as are switches 10 and 12, or it may be separate, but in any case should be at a frequency many times that of switches 10 and 12. Alternatively, the counter preset, hence the speed reference, may be caused to vary with engine speed to vary the speed reference count against which the output count of counter 88 is compared. Gate 86 responds to the leading edge of the "not inject" pulse and begins providing a digital output consisting of a string of pulses effectively counting the length of the "not inject" pulse. This output is supplied to a digital presettable down counter 88. The "not inject" pulse is also supplied to a "preset" terminal on counter 88 through a line 90 where its trailing edge causes counter 88 to be preset to a count representing 40% duty cycle. If the "not inject" pulse is of such length as to represent more than 40% duty cycle, the preset count will be used up, any overage is ignored, and there is no output from the "carry" terminal of counter 88. If the count represents a duty cycle less than 40% of continuous injection, the preset count will not be counted down, a finite count remains in the counter, and there will be an output at the "carry" terminal of counter 88. This output again resets the multivibrators 62 and 66, causing a low output at their Q terminals resulting in switching the system back to two-group injection, as set forth above.

While FIG. 4 shows an AND gate 86, it is now commonplace for its function to be included in the presettable down counter 88 such that so long as a high voltage signal appears on its "preset" terminal it holds its preset count, and the clock input is ignored. When the "not inject" pulse arrives, it removes this constraint, the clock input will be received, and the counter will begin to count down from the preset value. Other counter arrangements could be employed such as a conventional "up" counter whose output is compared with a preset reference in a digital comparator and in which a failure to reach the preset reference count would result in an output to multivibrators 62 and 66. And while the functions of the latch circuits have been described in terms of multivibrators, other latch circuit arrangements may be used.

I claim:

1. In an electrical fuel injection system for an internal combustion engine having a number of electromagnetically actuated injectors electrically connected to form a plurality of independent injector groups which are alternately energized during low speed operation and simultaneously energized during certain high speed and power demand regimes of engine operation and including an electrical computer responsive to a plurality of engine operating conditions for providing electrical fuel injection pulses of the exact length required to meet the instantaneous fuel requirements of the engine;

a system for accomplishing the conversion from alternate energization of the injector groups to simultaneous energization and vice versa comprising:

engine driven means providing a plurality of electrical pulse trains each of which includes pulses directly proportional in number to engine revolutions and in which pulses from separate trains do not coincide in time, first latch means interconnected to receive said trains of pulses having output signals enabling one injector group in response to receipt of pulses from one of said trains and inhibiting another injector group, means differentiating said pulses to form sharp timing pulses and connected said timing pulses to said computer to time the start of said electrical fuel injection pulses, AND gate means connected to receive said timing pulses and said electrical fuel injection pulses producing output signals when said pulses coincide in time, and second latch means responsive to said output signals connected to said first latch means for inhibiting timing pulses from one of said trains and for directing timing pulses from another train of pulses to control timing of injection pulses to all of said injectors.

2. An electrical fuel injection system for an internal combustion engine as set forth in claim 1 wherein said conversion means includes comparing means connected to the output of said computer for measuring the length of said injection pulses and for producing an output when said individual injection pulses are representative of a duty cycle less than a threshold value, and means connecting the output from said comparing means to said second latch means to re-establish the timing pulses from said one train to convert operation back to alternate energization of said injector groups.

3. An electrical fuel injection system as set forth in claim 2 wherein said comparing means comprises an integrator and a level detector.

4. An electrical fuel injection system as set forth in claim 2 wherein said comparing means includes a clock, a digital down counter capable of being preset to a count corresponding to said threshold value such that counts in excess of said threshold value produce no output and counts below said threshold value produce an output.

5. An electrical fuel injection system as set forth in claim 2 wherein said comparing means includes a digital clock connected to receive said injection pulses, digital counter means connected to receive counts from said clock during said injection pulses, and reference means corresponding to a count representative of injection pulse lengths at said threshold value with which the counts from said counter are compared such that said output is produced when the counted pulses are representative of injection pulse lengths below said threshold value.

6. An electrical fuel injection system as set forth in claim 1 in which there are two injector groups, two pulse trains providing alternating pulses for each of said injector groups and two of said AND gate means, each of which receives differentiated pulses of one of said trains in addition to said fuel injection pulses.

7. An electrical fuel injection system as set forth in claim 6 wherein said first latch means includes first and second multivibrators, first and second AND gates connected to each of said first and second multivibrators, respectively, and first and second NAND gates connected to receive input signals from said first and second AND gates and connected to said first and second injector groups.

8. An electrical fuel injection system as set forth in claim 7 wherein said second latch means includes third and fourth multivibrators connected to said AND gate means, and a NOR gate connected between said third and fourth multivibrators and said AND gates, either of said multivibrators being operative when receiving a signal from one of said AND gate means to produce an output signal to one of said first and second multivibrator means capable of inhibiting one of said trains of pulses to said NOR gate to disable both of said AND gates such that fuel injection pulses are timed only by the other of said trains of pulses and both said NAND gates are enabled to provide simultaneous energization of both groups of injectors.

9. An electrical fuel injection system as set forth in claim 6 wherein said first latch means includes first and second switching means, gate means connected to each of said first and second switching means, and first and second output gate means connected to said gate means and to said first and second injector groups.

10. An electrical fuel injection system as set forth in claim 9 wherein said second latch means includes third and fourth switching means connected to said AND gate means, second gate means connected between said third and fourth switching means and said gate means, either of said third and fourth switching means being operative when receiving a signal from one of said AND gate means to produce an output signal to one of said first and second switching means capable of inhibiting one of said trains of pulses, to said second gate means to disable said gate means such that fuel injection pulses from said computer are timed only by the other of said trains of pulses, and said output gate means are enabled to provide simultaneous energization of both of said injector groups.

11. An electrical fuel injection system as set forth in claim 7 wherein signals responsive to deceleration of said engine are connected to said NAND gates and disable said NAND gates from providing output signals to said injector groups.

* * * * *